US007230148B2

(12) United States Patent
Himelfarb et al.

(10) Patent No.: US 7,230,148 B2
(45) **Date of Patent: *Jun. 12, 2007**

(54) PROCESS FOR HYDROGENATION OF AROMATICS IN HYDROCARBON FEEDSTOCKS CONTAINING THIOPHENEIC COMPOUNDS

(75) Inventors: Paul Benjerman Himelfarb, Houston, TX (US); Charles Eugene Wilson, Missouri City, TX (US)

(73) Assignee: Shell Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/397,063

(22) Filed: Apr. 4, 2006

(65) Prior Publication Data

US 2006/0167327 A1 Jul. 27, 2006

Related U.S. Application Data

(62) Division of application No. 10/213,996, filed on Aug. 7, 2002, now Pat. No. 7,081,555.

(51) Int. Cl.
*C07C 5/10* (2006.01)

(52) U.S. Cl. ..... 585/270; 585/269

(58) Field of Classification Search ..... 585/269, 585/270

See application file for complete search history.

(56) References Cited

U.S. PATENT DOCUMENTS

| | | | | |
|---|---|---|---|---|
| 2,101,104 | A | 12/1937 | Smith et al. | |
| 3,234,298 | A | 2/1966 | Van Zijil Langhout et al. | |
| 3,472,763 | A | 10/1969 | Nanterre et al. | 208/255 |
| 3,674,707 | A | 7/1972 | Pieters et al. | |
| 3,700,742 | A * | 10/1972 | Hayes | 585/267 |
| 3,714,030 | A * | 1/1973 | Winsor et al. | 208/210 |
| 3,755,148 | A | 8/1973 | Mickelson | 208/143 |
| 3,775,506 | A | 11/1973 | Houston, Jr. et al. | |
| 3,793,388 | A | 2/1974 | Pitzer | |
| 3,798,279 | A | 3/1974 | Cessou et al. | |
| 3,856,831 | A | 12/1974 | Tateishi et al. | |
| 3,859,370 | A | 1/1975 | Carter et al. | |
| 3,899,543 | A | 8/1975 | Cosyns et al. | |
| 4,098,683 | A * | 7/1978 | Conway | 208/216 PP |
| 4,118,342 | A | 10/1978 | Debus et al. | |
| 4,160,745 | A | 7/1979 | Murrell et al. | |
| 4,249,907 | A | 2/1981 | Callejas | 23/230 A |
| 4,327,234 | A | 4/1982 | Nowack et al. | 585/267 |
| 4,361,705 | A | 11/1982 | Marcelin et al. | 568/462 |
| 4,695,560 | A | 9/1987 | Gattuso et al. | 502/222 |
| 4,716,256 | A | 12/1987 | Johnson et al. | 585/274 |
| 4,734,540 | A | 3/1988 | Gattuso et al. | 585/274 |
| 4,761,510 | A | 8/1988 | Naruse et al. | 585/268 |
| 4,920,089 | A | 4/1990 | Van Beek et al. | 502/335 |
| 4,973,785 | A | 11/1990 | Lok et al. | 585/481 |
| 5,081,083 | A | 1/1992 | Wright | 502/50 |
| 5,095,160 | A | 3/1992 | Penella et al. | 585/476 |
| 5,189,233 | A | 2/1993 | Larkin et al. | 585/265 |
| 5,277,794 | A | 1/1994 | Delaney et al. | 208/143 |
| 5,451,312 | A | 9/1995 | Apelian et al. | 208/143 |
| 5,482,616 | A | 1/1996 | Brahma et al. | 208/143 |
| 5,773,670 | A | 6/1998 | Gildert et al. | 585/266 |
| 5,856,603 | A | 1/1999 | Rekker et al. | 585/270 |
| 5,954,948 | A | 9/1999 | Galperin | 208/111.35 |
| 6,197,721 | B1 | 3/2001 | Didillon et al. | 502/326 |
| 7,081,555 | B2 * | 7/2006 | Himelfarb et al. | 585/270 |
| 2002/0188161 | A1 * | 12/2002 | Kallenbach | 585/266 |

FOREIGN PATENT DOCUMENTS

| | | |
|---|---|---|
| EP | 0731156 A2 | 9/1996 |
| GB | 1412155 | 5/1973 |
| RU | 2139843 C1 | 10/1999 |
| WO | WO 96/37168 A | 8/1998 |

OTHER PUBLICATIONS

"Deactivation of Fixed-Bed Nickel Hydrogenation Catalysts by Sulfur," by E.K. Poels in Fuel 1995, vol. 74, No. 12, 1995, no month.

Seoane, X.L., Arcoya, A., Gonzalez, J. A., and Travieso, N., Hydrogenation of Ethylbenzene over a Nickel/Mordenite Catalyst. Catalytic Decay by Thiophene Poisoning, *Ind. Eng. Chem. Res.* 1989, 28, pp. 260-264, no month.

Marécot, P., Paraiso, E., Dumas, J.M., and Barbier, J., "Deactivation of Nickel Catalysts by Sulphur Compounds I. Benzene Hydrogenation," *Applied Catalysis A: General*, 80 (1992) pp. 79-88, no month.

Marécot, P., Paraiso, E., Dumas, J.M., and Barbier J., Deactivation of Nickel Catalysts by Sulphur Compounds II. Chemisorption of Hydrogen Sulphide, *Applied Catalysis A: General*, 80 (1992) pp. 89-97, no month.

International Search Report of Dec. 16, 2003.

* cited by examiner

*Primary Examiner*—Elizabeth E. Wood
(74) *Attorney, Agent, or Firm*—Charles W. Stewart

(57) ABSTRACT

The present invention relates to an improved process for the hydrogenation of aromatics in hydrocarbon feedstocks containing thiopheneic compounds as impurities, the aromatics hydrogenation being conducted in a hydrogenation reactor in the presence of a nickel based catalyst. The improvement comprises operating the hydrogenation reactor at a reaction temperature sufficiently high from the start of a run, that the thiopheneic compounds are decomposed and substantially absorbed into the bulk of the nickel catalyst, thereby substantially extending the life of the catalyst.

20 Claims, 3 Drawing Sheets

PROCESS FOR HYDROGENATION OF AROMATICS IN HYDROCARBON FEEDSTOCKS CONTAINING THIOPHENEIC COMPOUNDS

"This application is a division of application Ser. No. 10/213,996 filed Aug. 7,2002, now U.S. Pat. No. 7,081,555, the entire disclosure of which is hereby incorporated by reference."

FIELD OF THE INVENTION

The present invention is directed to a process for the hydrogenation of aromatics using nickel based catalysts. More particularly, the present invention relates to the hydrogenation of aromatics in hydrocarbon feedstocks containing thiopheneic compounds, which are known to deactivate nickel catalysts and to substantially reduce catalyst life.

BACKGROUND OF THE INVENTION

Nickel-containing catalysts are widely used to hydrogenate aromatic compounds in various hydrocarbon feedstocks. Because of the sensitivity of nickel catalysts to poisoning by sulfur compounds commonly found in such feedstocks, the feedstocks are normally desulfurized to a considerable degree prior to being contacted with the nickel catalyst. Despite the desulfurization step, it is not uncommon for small amounts of sulfur impurities to remain in the feedstocks, including aromatic sulfur compounds, such as thiophene, benzothiophene and dibenzothiophene, which are particularly poisonous to supported nickel catalysts.

Because the poisoning of nickel catalysts by sulfur compounds is a severe world wide problem, extensive studies have been conducted in various laboratories in an attempt to determine the mechanism of sulfur poisoning, sometimes with conflicting results. For example, in the work by Poels, E. K., van Beek, W. P., den Hoed, W., Visser, C. (1995); *Fuel* Vol. 74 No. 12, pp 1800-1805, sulfur poisoning on a variety of nickel catalysts having a wide range of nickel surface area was evaluated. The authors concluded for all the catalysts tested that surface poisoning by sulfur was the predominate deactivation mechanism. This study suggested that sulfur absorption could be switched from surface to bulk using higher temperature and lower sulfur content in the feeds. However, they concluded that moving into bulk sulfur absorption did not extend catalyst life, as a surface layer still controlled catalyst deactivation. Others have reported that bulk sulfur absorption can occur with thiol type sulfur, but not with thiophenes. While there may be disagreement as to the precise mechanism of sulfur poisoning, it is generally accepted that the toxicity of sulfur compounds found in hydrocarbon feedstocks increases with the molecular weight and the complexity of the molecule, with thiopheneic compounds, such as thiophene, benzothiophene and dibenzothiophene being especially detrimental to nickel catalysts. A possible explanation for this is that higher molecular weight sulfur compounds, such as thiopheneic compounds, are not as readily decomposed as thiols, sulfides and mercaptans, but instead are adsorbed on the surface of the nickel catalyst forming a stable surface species which blocks active catalyst sites. This adsorption of thiopheneic compounds on the surface of the catalyst is generally believed to be irreversible due to the high heat of adsorption of these compounds. Since surface adsorption of sulfur compounds reduces active sites, catalyst vendors often quote catalyst lifetimes based on the sulfur in the feed and flows to get roughly one layer coverage of sulfur on the surface of the catalyst. Nickel based catalysts used to hydrogenate aromatics in feedstocks containing thiopheneic compounds generally have shorter catalyst lives than feedstocks containing lower molecular weight sulfur compounds, because of the tendency of the thiopheneic compounds under conventional process conditions to be adsorbed on the surface of the catalyst, thereby deactivating it. Accordingly, it can be seen that an aromatics hydrogenation process operated in such a manner that thiopheneic compounds in the feedstock did not poison or deactivate the nickel based catalyst employed in the process, would be highly desirable. The present invention provides such an improved process.

SUMMARY OF THE INVENTION

It has now been found, contrary to teachings in the prior art, that the lifetimes of nickel based catalysts exposed to thiopheneic compounds present in hydrocarbon feedstocks can be extended for considerable periods of time by control of certain process conditions as hereinafter described. Accordingly, the present invention is directed to an improved process for the hydrogenation of aromatics in hydrocarbon feedstocks containing thiopheneic compounds as impurities, the aromatics hydrogenation being conducted in a hydrogenation reactor in the presence of nickel based catalysts. The improvement comprises operating the hydrogenation reactor at a reaction temperature sufficiently high from the start of a run, that the thiopheneic compounds are decomposed and substantially absorbed into the bulk of the nickel based catalyst. It has been found that by operating the reactor at a higher reaction temperature from the start of the run, the thiopheneic compounds decompose and enter into the bulk nickel, instead of being adsorbed on the surface of the catalyst, thereby decreasing the poisoning impact of the thiopheneic compounds and substantially extending the life of the catalyst.

DETAILED DESCRIPTION OF THE INVENTION

Figure 1:
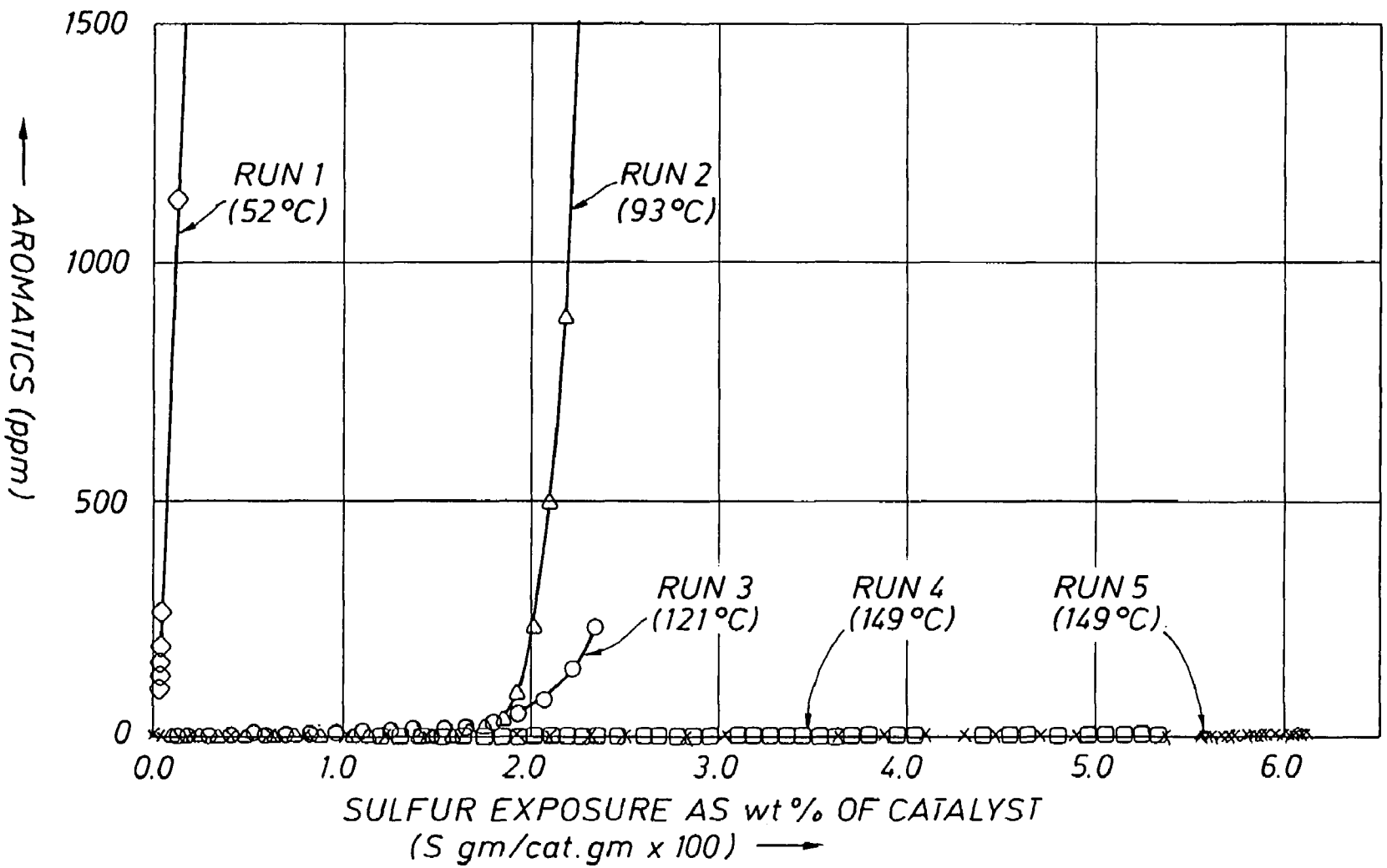
FIG. 1 is a graph showing the effect of reaction temperature on sulfur poisoning of a nickel catalyst by a thiopheneic compound in a hydrocarbon solvent feedstock. The results are expressed in terms of as aromatics concentration in the product as a function of sulfur exposure and reaction temperature.

The present invention relates to an improved process for hydrogenating aromatics in hydrocarbon feedstocks containing thiopheneic compounds using nickel based catalysts. The term "thiopheneic compounds" as used herein is intended to include relatively high molecular weight aromatic sulfur compounds such as thiophene, benzothiophene, dibenzothiophene and the like, which are known poisons to nickel based catalysts.

The improved aromatics hydrogenation process of the present invention involves contacting a hydrocarbon feedstock containing aromatics and thiopheneic compounds with an activated nickel based catalyst in a reactor, at a relatively high reaction temperature from the start of the run. Typically, a new charge of nickel catalyst is "activated" following a procedure recommended by the catalyst vendor. The activation procedure usually involves heating the catalyst in the reactor at specified heating rates and for specified periods of time in flowing hydrogen which reduces the nickel catalyst thereby activating it. Specifically, this step reduces nickel oxide to nickel metal. The latter is the active site in the catalyst. After the catalyst is "activated" the reactor is cooled down and the run is started by introducing hydrocarbon feedstock into the reactor with hydrogen. Because, nickel catalysts are generally believed to deactivate more rapidly at higher temperatures, commercial aromatics hydrogenation reactors are normally started at the lowest temperature required to meet product specifications. As the catalyst deactivates over time, the reactor temperature is raised to compensate for the loss in activity.

The basis for the present invention is the suprising discovery that by operating the aromatics hydrogenation process at an elevated temperature from the start of the run, it is possible to convert thiopheneic compounds into species that are diffused or absorbed into the bulk of the nickel catalyst instead of forming surface species which poison the catalyst. Because of this, nickel catalysts employed in the improved process of the invention have longer lifetimes, in some cases up to three times or more the lifetimes of catalysts run on the same feed at a lower starting temperature.

A further suprising discovery is that if the process is operated at a lower temperature initially and the catalyst deactivates, the activity cannot be restored by raising the temperature to elevated levels thereafter. It appears that once the thiopheneic compounds are adsorbed on the surface of the catalyst and cover a substantial number of active sites, it is difficult to substantially restore lost activity. Thus, the key to the improved process of the present invention is to operate the process at an elevated temperature from the start of the run, and to maintain the process at a temperature sufficiently high that the thiopheneic compounds present in the feedstock continue to be converted into a species which is absorbed into the catalyst bulk, instead of being adsorbed on the catalyst surface.

The term "start of the run" as used herein generally refers to the point in time that feedstock containing thiopheneic compounds and hydrogen are first introduced into a reactor containing a new or fresh charge of active nickel based catalyst. "Start of the run" generally does not include any catalyst activation procedure per se, which is normally accomplished in the absence of feedstock. While it is preferred to bring the reactor to the required high temperature from the time feedstock and hydrogen are first introduced into the reactor, the term "start of the run" in its broader sense is intended to include any point in time before the nickel catalyst adsorbs a substantial amount of thiopheneic compounds on its surface. Thus, short delays in bringing the reactor to the required temperature after feedstock introduction is still considered to come within meaning of "start of the run", and to be within the scope of the present invention.

The term "reaction temperature" refers to the temperature at which the hydrocarbon feedstock and hydrogen make initial contact with active nickel catalyst in the reactor. In a typical fixed-bed downflow reactor with a fresh charge of catalyst, the "reaction temperature" will be essentially the same as the reactor inlet temperature. Since the hydrogenation of aromatics is an exothermic reaction, there will usually be temperature differential across the catalyst bed, with the reactor outlet temperature normally being higher than the reactor inlet temperature. As a run progresses, that portion of catalyst in the reactor with the greatest exposure to sulfur compounds will deactivate first, and hydrogenation of aromatics will occur in subsequent portions of the catalyst bed until there is insufficient active catalyst remaining in order to meet product specifications, at which time the catalyst will be need to be replaced.

In practice of the improved process of the present invention it is critical that the reaction temperature be maintained from the start of the run sufficiently high that the thiopheneic compounds present in the hydrocarbon feedstock will be converted to into a species which is absorbed in the bulk of the nickel, instead of being adsorbed on the surface of the catalyst. It is also important that the temperature throughout the reactor not exceed the temperature at which unwanted side reactions, such as cracking will occur.

While the reaction temperature in accordance with the present invention may vary somewhat depending on the activity of the nickel based catalyst being used and the particular reactor design, the reaction temperature from the start of the run will generally range from about 140° C. to about 225° C., preferably from about 149° C. to about 200° C., and most preferably from 150° C. to about 175° C. Based on the foregoing teachings and the examples, it will be apparent to those skilled in the art what reaction temperatures to employ to obtain bulk sulfiding of thiopheneic compounds in various other types of reactors which may be used for aromatics hydrogenation.

Other suitable process conditions for carrying out the improved aromatics hydrogenation process of the invention include a total pressure of about 200 psig to about 800 psig, preferably from about 300 psig to about 600 psig, and a liquid hourly space velocity (LHSV) of from about 0.5 to about 5.0, preferably from about 1.0 to about 3.0.

Hydrogen use in terms of hydrogen consumption basis the total hydrogen flow is in the range of from about 5% to about 80%, preferably in the range of from about 20% to about 50%.

Hydrocarbon feedstocks suitable for use in the improved aromatics hydrogenation process of the present invention include any hydrocarbon or mixture of hydrocarbons boiling in the range of about 80° C. to about 350° C. and containing from about 1 w % to about 80 w % aromatics, up to 100 w % aromatics, preferably from about 2 w % to about 50 w % aromatics. It is noted that in commercial practice with higher aromatic concentrations in the feed, it is typical to dilute the feed with product recycle to control heat release, thereby diluting the actual aromatic level reaching the catalyst in the reactor.

The improved aromatics hydrogenation process of the invention can be employed to reduce the aromatics concentration in the hydrocarbon feedstocks being treated to the desired level. For example, depending on product specifications, to levels of less than about 0.2 w %, less than about 0.02 w %, or even less than about 0.002 w %, (the latter value being the limit of detection).

Suitable feedstocks include light and heavy solvents, white oils, naphtha, kerosene, diesel and the like containing from 0.1 ppm to 50 ppm thiopheneic compounds, preferably from about 0.2 ppm to about 10 ppm thiopheneic compounds. The improved process of the invention is particularly advantageous in the dearomatization of hydrocarbon solvent feedstocks, such as light and heavy solvents, including naphtha, boiling in the range of from about 80° C. to about 350° C. Applications for the solvent products after hydrogenation include use in coatings (paint, varnishes and lacquers), industrial cleaners, printing inks, extractive processes, and pharmaceuticals.

Any modern nickel based catalyst may be employed in the improved aromatics hydrogenation process of the invention. This includes catalysts prepared by impregnation referred as supported nickel catalysts and also those prepared by coprecipitation referred to as bulk nickel catalysts. Supported nickel catalysts which may be used in the process of the invention will generally have a nickel content of from about 10 w % to about 35 w %, preferably from about 15 w % to about 30 w %. Bulk nickel catalysts which may be used in the process of the invention will generally have a nickel content from about 20 w % to about 80 w %, with a nickel content of about 30 w % to about 70 w % being preferred. The nickel contents are all based on final, activated (reduced) catalyst. Thus, the overall range of nickel contents for the nickel based catalysts suitable for use in the improved process of the invention is from about 10 w % to about 80 w %. The nickel catalysts suitable for use in the present process may include minor amounts of other catalytic metals as long as such metals do not interfer with the decomposition of the thiopheneic compounds and formation of the bulk sulfur species.

Suitable supports for supported nickel based catalysts include one or more refractory oxides such as alumina, silica, silica alumina, titania, zirconia and combinations thereof. Alumina, silica, or mixtures thereof, are particularly preferred supports. The BET surface area of the final catalyst may range from about 40 $m^2/g$ to about 300 $m^2/g$, preferably from about 80 $m^2/g$ to about 250 $m^2/g$.

The following examples will serve to illustrate the invention disclosed herein. These examples are intended only as a means of illustration and should not be construed as limiting the scope of the invention in any way. Those skilled in the art will recognize many variations that may be made without departing from the spirit of the disclosed invention.

EXAMPLE 1

A set of experiments was conducted to demonstrate the effect of reaction temperature on the poisoning of supported nickel catalysts used for hydrogenation of hydrocarbon feedstocks containing thiopheneic compounds. The catalyst used in these experiments was a commercially available high activity nickel catalyst containing 28 w % nickel on an alumina support having a BET surface area of 120-140 $m^2/g$. The catalyst was supplied in a pre-reduced and air stabilized form. A 25 cc portion of the catalyst (with a 1:6 dilution with silicon carbide to ensure catalyst particle wetting) was placed in a conventional fixed-bed down-flow reactor. The catalyst was activated in flowing hydrogen at approximately 8 liters/hour by heating the catalyst to 120° C. at 40° C./hr and holding for two hours, followed by heating to 230° C. at 40° C./hr and holding for an additional two hours to reduce surface nickel oxide. The catalyst was then cooled to room temperature.

Five runs were conducted using a hydrocarbon solvent feedstock with a boiling point range of from 103° C. to 302° C., with an aromatics content of 17 w %, and containing approximately 50 ppm of benzothiophene. Each of the five runs was conducted at process conditions including: a LHSV of 1, a pressure of 530 psig, volume hydrogen/volume feed of approximately 500. The only variable between the different runs was the reaction temperature. For Run 1 the reaction temperature from the start of the run was 52° C. For Run 2 the reaction temperature from the start of the run was 93° C. For Run 3 the reaction temperature from the start of the run was 121° C. For each of Runs 4 and 5 the reaction temperature from the start of the runs was 149° C.

The results of these five runs, showing aromatics concentration as a function of sulfur exposure (i.e., benzothiophene exposure) and reaction temperature, is presented in FIG. 1. Note that the sulfur exposure, given as a percent of sulfur per weight of catalyst, is calculated bases the sulfur (benzothiophene) level in the feed passed over the catalyst. At the lowest temperature (52° C.), the catalyst almost immediately deactivates with negligible sulfur (0.1 w %) on the catalyst. At moderate temperatures (92° C. and 121° C.), the catalyst appears deactivated at about 2 w % sulfur on the catalyst. At the higher reaction temperature of 149° C., which is in accordance with the present invention, there is no indication of catalyst deactivation with over 6 w % sulfur on the catalyst. The catalyst used in Run 5 was analyzed for sulfur content and was found to have 6.5 w %, which is in good agreement with the calculated value. The sulfur level in the product was measured periodically in Runs 4 and 5 and was always less than 1 ppm, while the feed had about 50 ppm. Thus, all the benzothiophene in the feed passed over the catalyst was converted to a species which was absorbed on/into the catalyst bulk without deactivating it.

The foregoing experiments indicate that at low temperatures (52° C.) deactivation occurs very rapidly, partially due to low activity of the catalyst at this temperature, with sulfur loading increasing the deactivation rate. At moderate temperatures (93° C. and 121° C.), the catalyst showed a rapid deactivation at about 2% sulfur loading, which level corresponds to approximately one monolayer coverage over the available nickel surface. At the higher reaction temperature (149° C.), in accordance with the invention, the sulfur level of 6.5 w % on the catalyst when the run was stopped corresponds to over three monolayers coverage, which together with the continued high activity, indicates bulk sulfiding is occurring instead of deactivating surface sulfiding.

EXAMPLE 2

Figure 2:
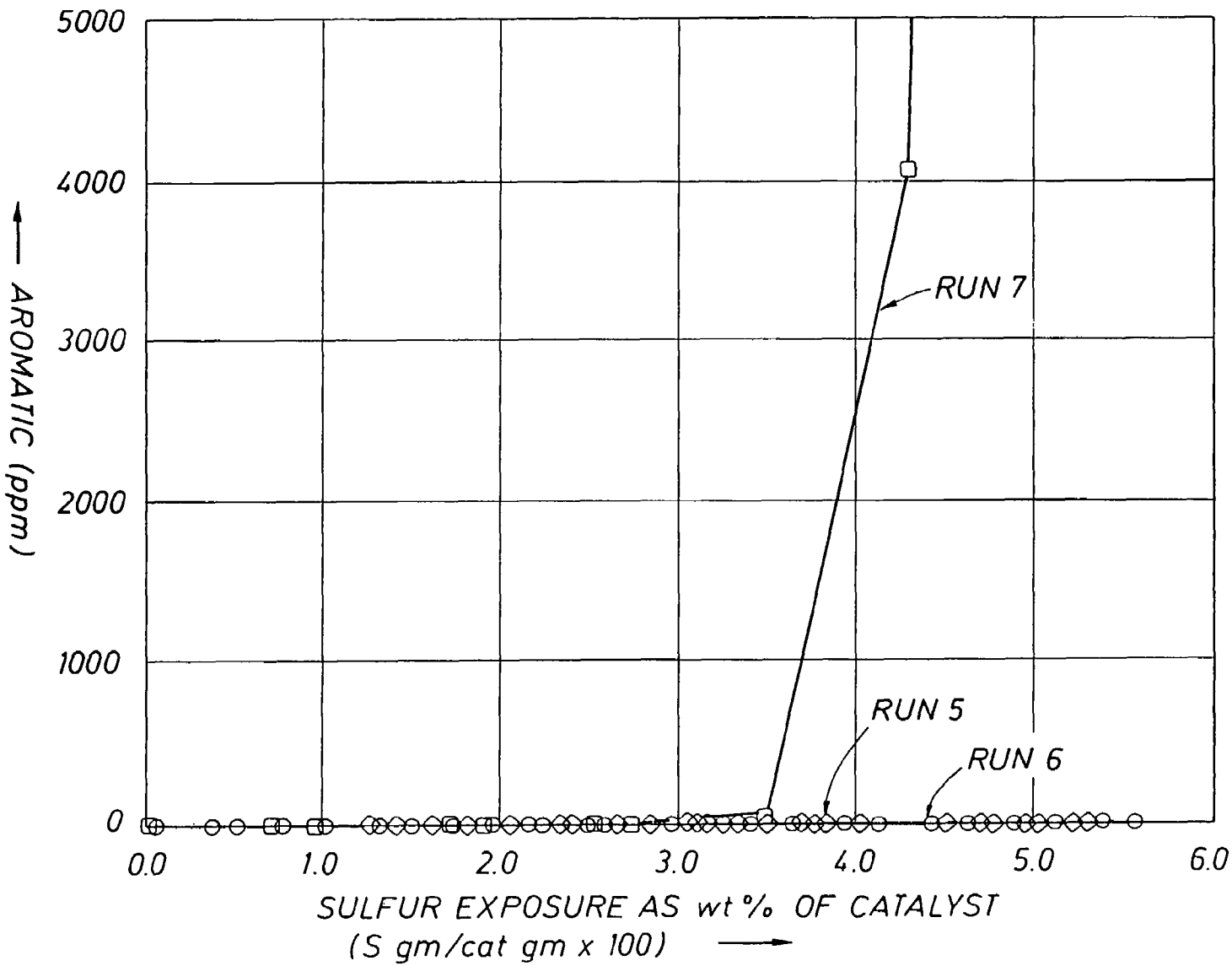
FIG. 2 is a graph showing aromatics concentration in the product from the hydrogenation of a hydrocarbon solvent feedstock containing different thiopheneic compounds at different concentrations.

To demonstrate that the bulk nickel sulfiding observed with benzothiophene at high temperatures was applicable to other thiopheneic compounds, a further study was conducted using thiophene, as well as benzothiophene at two different concentration levels. This study involved two additional runs (Runs 6 and 7) using the same catalyst, hydrocarbon solvent feedstock and process conditions as in Example 1, except all the runs were conducted at a temperature of 149° C. The only variables between the three runs was the concentration and type of thiopheneic compounds which were as follows: Run 6 approximately 50 ppm thiophene, Run 5 approximately 50 ppm benzothiophene (same as in Example 1, above), and Run 7 approximately 400 ppm benzothiophene. The results of these three runs are shown in FIG. 2.

The results of Runs 5 and 6 show that thiophene behaves similar to benzothiophene and that bulk sulfiding can be obtained for either, provided the proper reaction temperature is employed from the start of the run. In Run 7 the catalyst was deactivated with approximately 3.5% sulfur loading, as compared to no apparent deactivation with sulfur loadings up to 6.5% for Runs 5 and 6. This indicates that at very high concentrations of thiopheneic compounds in the feedstock (400 ppm), the surface sulfur poisoning has a greater effect on the catalyst and can reduce the beneficial effects of bulk sulfiding.

EXAMPLE 3

Figure 3:
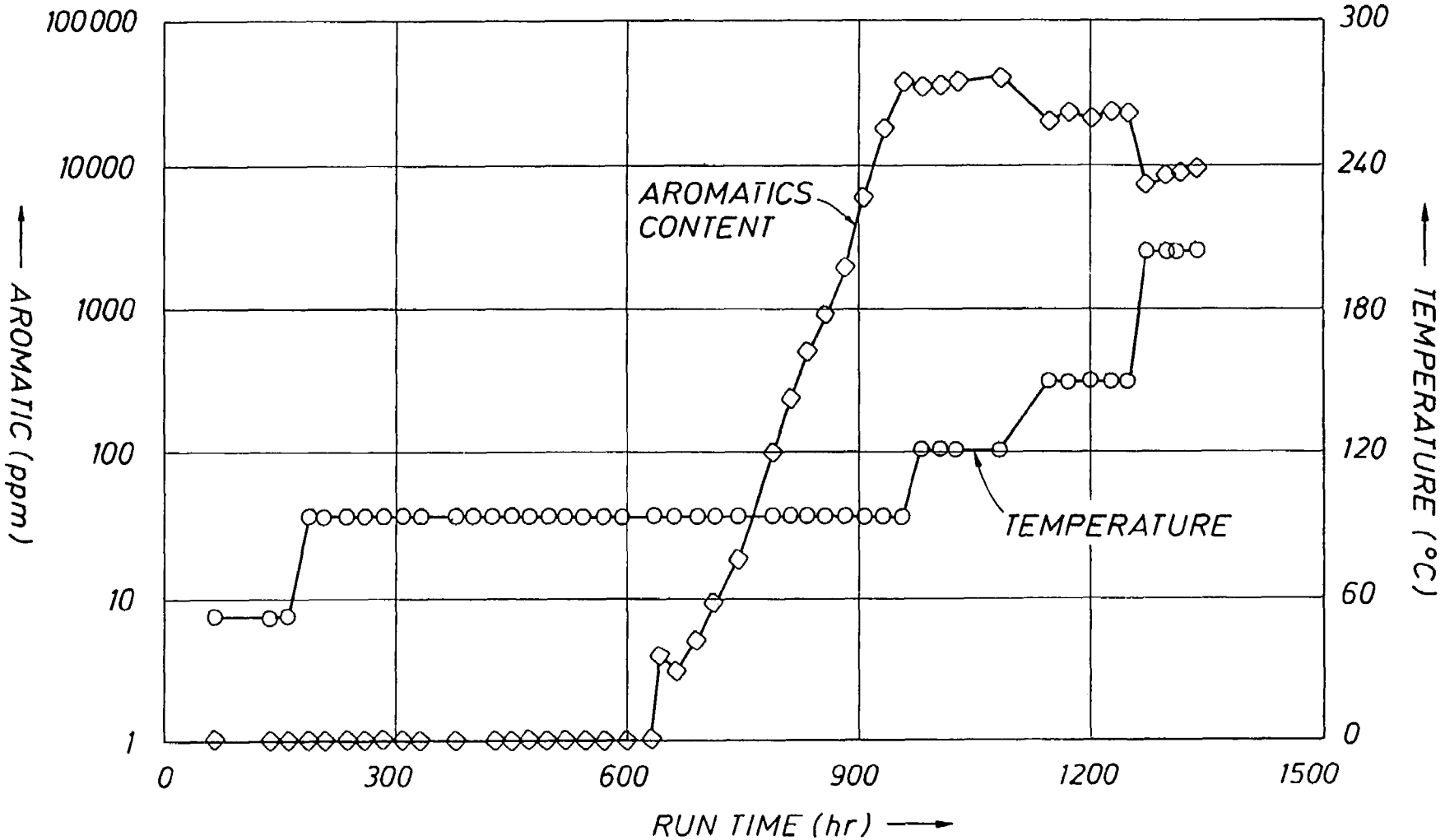
FIG. 3 is a graph showing the attempted recovery of a deactivated nickel catalyst by raising the temperature to elevated levels.

An experiment was conducted to determine if the activity of a catalyst poisoned by sulfur adsorbed on the surface of the catalyst at low or moderate reaction temperatures, could be recovered by raising the reaction temperature to a higher temperature were bulk sulfiding takes place. In this experiment, after the catalyst in Run 2 at 93° C. was surface sulfur poisoned, the reaction temperature was raised in several steps to 200° C. From the results of this experiment shown in FIG. 3, it can be seen that by raising the temperature further deactivation can be stopped, but the activity already lost can be only marginally recovered, in spite of the fact that the upper temperature used (200° C.) was over 50° C. higher than required for bulk sulfur deposition had the proper reaction temperature been used from the start of the run.

The above examples demonstrate that sulfur poisoning by thiopheneic compounds of supported nickel catalysts used for aromatics hydrogenation can be avoided in accordance with the improved process of the present invention, by employing a reaction temperature from the start of the run which is conducive to the absorption of the sulfur into the bulk of the nickel, rather than being adsorbed on the surface of the catalyst. Because more than three times as much sulfur from thiopheneic compounds can be absorbed into the bulk of the catalyst without deactivating it, the improved process of the present invention results in a dramatic enhancement of catalyst life, e.g., up to a threefold or more increase.

We claim:

1. A process for the hydrogenation of aromatics in a hydrocarbon feedstock, comprising:

contacting said hydrocarbon feedstock, which contains aromatics in the range of from 1 w % to 80 w % and thiopheneic compounds in the range of from 0.1 ppm to 50 ppm, with an activated bulk nickel catalyst contained within a reactor, having a reactor inlet and a reactor outlet, and wherein said activated bulk nickel catalyst has a nickel content in the range of from about 20 w % to about 80 w %, based on said activated bulk nickel catalyst, at a start of the run reaction temperature in the range of from about 140° C. to about 225° C.; and yielding a treated hydrocarbon feedstock having a reduced aromatics concentration of less than 0.2 w %.

2. A process as recited in claim 1, wherein said hydrocarbon feedstock is a hydrocarbon solvent feedstock boiling in the range of from about 80° C. to about 350° C. and contains from 2 w % to 50 w % aromatics and from 0.2 ppm to 10 ppm thiopheneic compounds.

3. A process as recited in claim 1, wherein said treated hydrocarbon feedstock has a sulfur level of less than 1 ppm.

4. A process as recited in claim 1, wherein the sulfur exposure of said activated bulk nickel catalyst is such that said activated bulk nickel catalyst contains more than 2 w % sulfur before the deactivation of the said activated bulk nickel catalyst.

5. A process as recited in claim 1, wherein said start of the run reaction temperature is in the range of from 149° C. to 200° C.; wherein said nickel content of said activated bulk nickel catalyst is in the range of from 30 w % to 70 w %, and wherein said reduced aromatics concentration of said treated hydrocarbon feedstock is less than 0.02 w %.

6. A process as recited in claim 1, wherein said contacting step includes contacting hydrogen as well as said hydrocarbon feedstock with said activated bulk nickel catalyst under process conditions including a total pressure in the range of from 200 psig to 800 psig and a liquid hourly space velocity in the range of from 0.5 to 5.0.

7. A process as recited in claim 1, wherein the sulfur exposure of such activated bulk nickel catalyst is such that said activated bulk nickel catalyst contains more than 6 w % sulfur before the deactivation of the said activated bulk nickel catalyst.

8. A process as recited in claim 1, wherein said aromatics concentration of said treated hydrocarbon feedstock is less than 0.002 w %.

9. A process as recited in claim 2, wherein said treated hydrocarbon feedstock has a sulfur level of less than 1 ppm.

10. A process as recited in claim 2, wherein the sulfur exposure of said activated bulk nickel catalyst is such that said activated bulk nickel catalyst contains more than 2 w % sulfur before the deactivation of the said activated bulk nickel catalyst.

11. A process as recited in claim 3, wherein the sulfur exposure of said activated bulk nickel catalyst is such that said activated bulk nickel catalyst contains more than 2 w % sulfur before the deactivation of the said activated bulk nickel catalyst.

12. A process as recited in claim 2, wherein said start of the run reaction temperature is in the range of from 149° C. to 200° C.; wherein said nickel content of said activated bulk nickel catalyst is in the range of from 30 w % to 70 w %, and wherein said reduced aromatics concentration of said treated hydrocarbon feedstock is less than 0.02 w %.

13. A process as recited in claim 3, wherein said start of the run reaction temperature is in the range of from 149° C. to 200° C.; wherein said nickel content of said activated bulk nickel catalyst is in the range of from 40 w % to 70 w %, and wherein said reduced aromatics concentration of said treated hydrocarbon feedstock is less than 0.02 w %.

14. A process as recited in claim 4, wherein said start of the run reaction temperature is in the range of from 149° C. to 200° C.; wherein said nickel content of said activated bulk nickel catalyst is in the range of from 30 w % to 70 w %, and wherein said reduced aromatics concentration of said treated hydrocarbon feedstock is less than 0.02 w %.

15. A process as recited in claim 2, wherein said contacting step includes contacting hydrogen as well as said hydrocarbon feedstock with said activated bulk nickel catalyst under process conditions including a total pressure in the range of from 200 psig to 800 psig and a liquid hourly space velocity in the range of from 0.5 to 5.0.

16. A process as recited in claim 3, wherein said contacting step includes contacting hydrogen as well as said hydrocarbon feedstock with said activated bulk nickel catalyst under process conditions including a total pressure in the range of from 200 psig to 800 psig and a liquid hourly space velocity in the range of from 0.5 to 5.0.

17. A process as recited in claim 4, wherein said contacting step includes contacting hydrogen as well as said hydrocarbon feedstock with said activated bulk nickel catalyst under process conditions including a total pressure in the range of from 200 psig to 800 psig and a liquid hourly space velocity in the range of from 0.5 to 5.0.

18. A process as recited in claim 5, wherein said contacting step includes contacting hydrogen as well as said hydrocarbon feedstock with said activated bulk nickel catalyst under process conditions including a total pressure in the range of from 200 psig to 800 psig and a liquid hourly space velocity in the range of from 0.5 to 5.0.

19. A process as recited in claim 18, wherein the sulfur exposure of such activated bulk nickel catalyst is such that said activated bulk nickel catalyst contains more than 6 w % sulfur before the deactivation of the said activated bulk nickel catalyst.

20. A process as recited in claim 19, wherein said aromatics concentration of said treated hydrocarbon feedstock is less than 0.002 w %.

* * * * *